US007824055B2

(12) United States Patent
Sherman

(10) Patent No.: US 7,824,055 B2
(45) Date of Patent: Nov. 2, 2010

(54) SHELF LIGHT ASSEMBLY

(75) Inventor: Ryan T. Sherman, Seattle, WA (US)

(73) Assignee: LucaLight, LLC, Seattle, WA (US)

( * ) Notice: Subject to any disclaimer, the term of this patent is extended or adjusted under 35 U.S.C. 154(b) by 236 days.

(21) Appl. No.: 11/935,319

(22) Filed: Nov. 5, 2007

(65) Prior Publication Data

US 2008/0285260 A1 Nov. 20, 2008

Related U.S. Application Data

(60) Provisional application No. 60/856,585, filed on Nov. 3, 2006.

(51) Int. Cl.
*A47F 11/00* (2006.01)

(52) U.S. Cl. ..... 362/125; 362/127; 362/133

(58) Field of Classification Search ..... 362/127, 362/132, 92, 235, 125; 248/247, 250
See application file for complete search history.

(56) References Cited

U.S. PATENT DOCUMENTS 2,038,035 A 4/1936 Friedrich
2,106,839 A 2/1938 Gilbert
D146,982 S 6/1947 Phillips
3,949,880 A * 4/1976 Fortunato ..... 211/119.003
4,164,009 A 8/1979 Maguire, Jr.
4,195,890 A 4/1980 Kellogg
4,365,590 A 12/1982 Ruggieri
4,434,453 A 2/1984 Campbell
4,489,995 A 12/1984 Barr
4,535,393 A * 8/1985 Aspenwall ..... 362/125

(Continued)

FOREIGN PATENT DOCUMENTS

DE 295 14 745 U1 11/1995

(Continued)

OTHER PUBLICATIONS

International Search Report dated May 7, 2008, issued in corresponding Application No. PCT/US07/83663, filed Nov. 5, 2007.

*Primary Examiner*—Jong-Suk (James) Lee
*Assistant Examiner*—Julie A Shallenberger
(74) *Attorney, Agent, or Firm*—Christensen O'Connor Johnson Kindness PLLC

(57) ABSTRACT

The present disclosure provides a light assembly (10) for connection to a shelf (16) having a top face (84), a front face (88), and a front edge (80) defined by the intersection of the top face (84) and the front face (88). The light assembly (10) includes an elongated housing (14) having an inner face (22), an outer face (30) formed opposite the inner face (22), and an upper face (26) extending between the inner face (22) and the outer face (30). The elongated housing (14) is adapted to receive a light source (34) therein. A mating portion (70) extends from the inner face (22) of the elongated housing (14) and is abuttable with a portion of a shelf (16) such that the upper face (26) of the elongated housing (14) is substantially flush with the top face (84) of the shelf (16) to form a continuous extension of the shelf (16). A clamp (96) extends from the mating portion (70) and is engageable with the shelf (16) to secure the elongated housing (14) to the shelf (16).

22 Claims, 6 Drawing Sheets

U.S. PATENT DOCUMENTS

| | | | | |
|---|---|---|---|---|
| 4,622,624 | A | 11/1986 | McCarthy | |
| 4,689,726 | A | 8/1987 | Kretzschmar | |
| 4,739,454 | A | 4/1988 | Federgreen | |
| 5,034,861 | A | 7/1991 | Sklenak | |
| 5,040,101 | A | 8/1991 | Aspenwall | |
| 5,072,343 | A | 12/1991 | Buers | |
| D330,090 | S | 10/1992 | Walter | |
| 5,508,898 | A | 4/1996 | McGovern | |
| 5,626,084 | A | 5/1997 | Kelly | |
| 5,690,415 | A | 11/1997 | Krehl | |
| 5,758,585 | A | 6/1998 | Latchinian | |
| 5,984,486 | A | 11/1999 | Munz | |
| 6,179,434 | B1 * | 1/2001 | Saraiji | 362/125 |
| 6,231,205 | B1 | 5/2001 | Slesinger | |
| D444,332 | S | 7/2001 | Zemke, Jr. | |
| 6,270,232 | B1 | 8/2001 | Shemitz | |
| 6,276,810 | B1 | 8/2001 | Vosshenrich | |
| 6,431,721 | B2 | 8/2002 | Shemitz | |
| 6,558,017 | B1 | 5/2003 | Saraiji | |
| 6,565,234 | B1 | 5/2003 | Skegin | |
| 6,755,551 | B2 | 6/2004 | Soorus | |
| 6,808,285 | B2 | 10/2004 | Shemitz | |
| 6,827,463 | B2 | 12/2004 | Chuang | |
| 6,827,465 | B2 | 12/2004 | Shemitz | |
| 6,974,375 | B1 | 12/2005 | Stevenson | |
| 2002/0080616 | A1 | 6/2002 | Chen | |
| 2003/0137828 | A1 * | 7/2003 | Ter-Hovhannisian | 362/92 |
| 2003/0174517 | A1 * | 9/2003 | Kiraly et al. | 362/555 |
| 2005/0082450 | A1 * | 4/2005 | Barrett et al. | 248/229.16 |
| 2005/0173605 | A1 | 8/2005 | Villeneuve | |
| 2006/0181885 | A1 | 8/2006 | Seng Tong | |

FOREIGN PATENT DOCUMENTS

| | | | |
|---|---|---|---|
| DE | 103 11 876 | A1 | 11/2004 |
| WO | 98/49490 | A1 | 11/1998 |

* cited by examiner

SHELF LIGHT ASSEMBLY

CROSS-REFERENCE TO RELATED APPLICATION

This application claims the benefit of U.S. Provisional Application No. 60/856,585, filed on Nov. 3, 2006, the disclosure of which is hereby expressly incorporated by reference.

BACKGROUND

Light assemblies for shelves are used to illuminate the contents on a shelf. These assemblies are designed to eliminate the need for overhead lighting or higher levels of ambient light. Light assemblies may be used for various types of shelving units, such as library shelves, magazine stands, retail shelves, grocery shelves, etc.

The light assemblies may be mounted above the shelving unit to illuminate the entire unit. Instead, individual light assemblies may be mounted to an edge or bottom surface of each shelf to illuminate the contents on the shelf below. Mounting the light assemblies to the edge or bottom surface of a shelf typically requires drilling holes in the shelf and mounting the light assembly thereto, which is time-consuming and destructive of the shelving unit. The light assemblies may instead be clamped to the edge of the shelf; however, the light assembly often disrupts the continuity of the shelf. This is inconvenient when it is desired to slide objects on and off the shelf, such as sliding books on and off the shelf in a bookstore or library.

Thus, it is desired to have a shelf light assembly that is adapted to be mounted to an edge of a shelving unit without disrupting the continuity of the shelf and without drilling holes in the shelf. It is further desired that the light assembly be mountable over an entire shelving unit to illuminate the entire contents of the shelving unit.

SUMMARY

The present disclosure provides a light assembly for connection to a shelf having a top face, a front face, and a front edge defined by the intersection of the top face and the front face. The light assembly includes an elongated housing having an inner face, an outer face formed opposite the inner face, and an upper face extending between the inner face and the outer face. The elongated housing is adapted to receive a light source therein. A mating portion extends outwardly from the inner face of the elongated housing and is abuttable with a portion of a shelf such that the upper face of the elongated housing is substantially flush with a top face of the shelf to form a continuous extension of the shelf. A clamp portion extends outwardly from the mating portion and is engageable with the shelf to secure the elongated housing to the shelf.

The present disclosure further provides a light assembly for connection to a shelf having a top face and an overhanging edge, wherein the light assembly comprises an elongated housing having an inner face, an outer face formed opposite the inner face, and an upper face extending between the inner face and the outer face. The elongated housing is adapted to receive a light source therein. A mating portion extends outwardly from the inner face of the elongated housing, and the mating portion is abuttable with a portion of a shelf such that the upper face of the elongated housing is substantially flush with a top face of the shelf to form a continuous extension of the shelf. A clamp extends outwardly from the mating portion and engageable with an overhanging edge of the shelf to secure the elongated housing to the shelf.

The present disclosure further provides a light assembly for connection to a shelf having a top face, a front face, and a front edge defined by the intersection of the top face and the front face, wherein the light assembly comprises an elongated housing, a mating portion, and means for securing the elongated housing to the shelf. The elongated housing includes a light housing portion adapted to receive a light source therewithin. The light housing portion includes a light housing inner face, a light housing outer face formed opposite the light housing inner face, and a light housing upper face extending between the light housing inner face and the light housing outer face. The elongated housing further includes a wire housing portion adapted to receive a wiring assembly therein. The wire housing portion includes a wire housing upper face, a wire housing bottom face formed opposite the wire housing upper face, and a wire housing inner face extending between the wire housing upper face and the wire housing bottom face. The wire housing portion is mateable with the light housing portion such that an upper face of the light housing portion is substantially flush with an upper face of the wire housing portion. The mating portion of the elongated housing extends outwardly from the inner face of the wire housing portion and is abuttable with a portion of a shelf such that the upper face of the wire housing portion is substantially flush with a top face of the shelf to form a continuous extension of the shelf.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
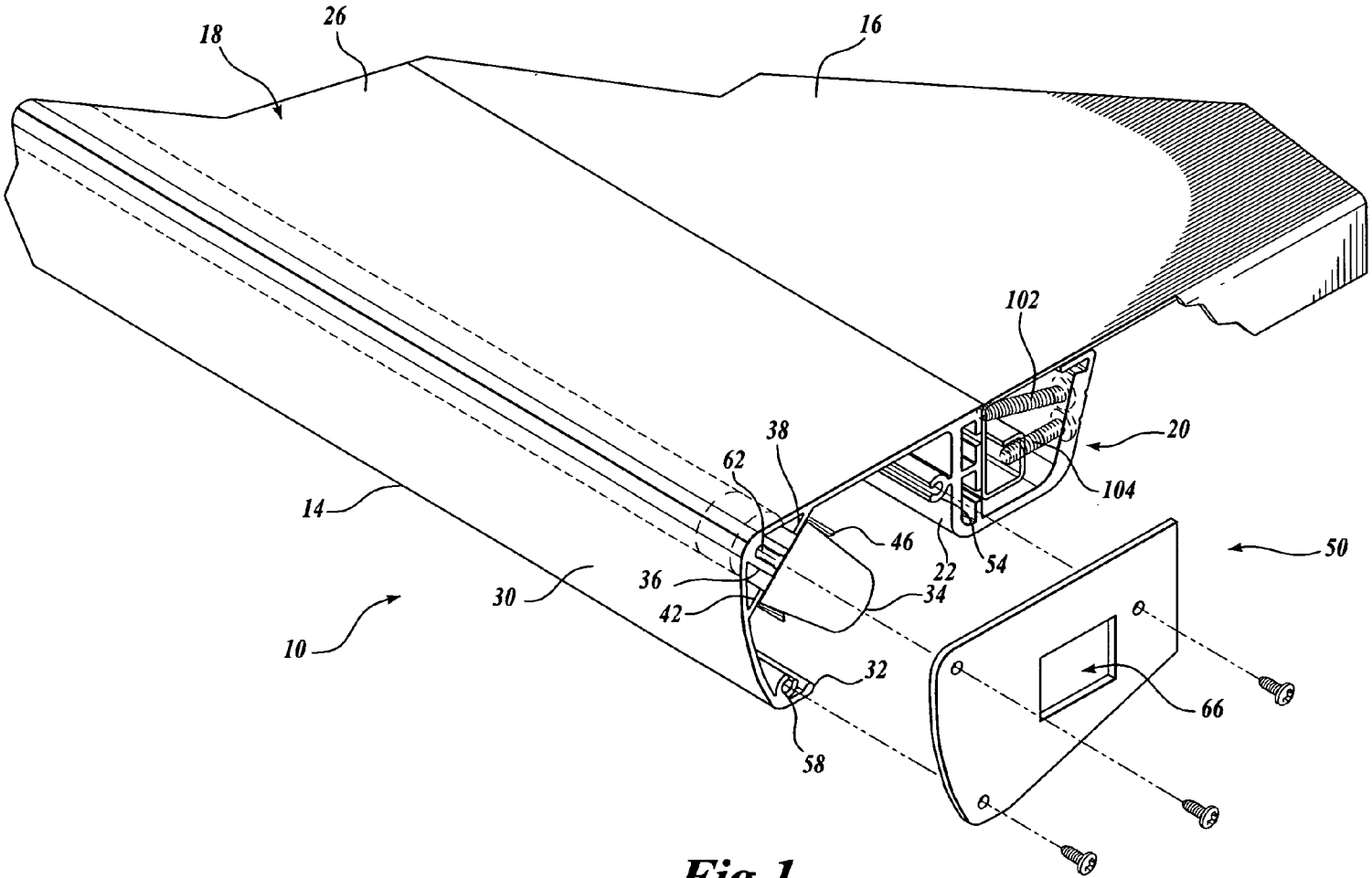
FIG. 1 is an isometric, partially exploded view of a shelf light assembly constructed in accordance with one embodiment of the present disclosure, wherein the shelf light assembly is mounted to the edge of a shelf.

Referring to FIG. 1, a shelf light assembly 10 formed in accordance with one embodiment of the present invention is depicted. The shelf light assembly 10 is mountable to a shelf to direct lighting towards the shelf contents below. Although certain embodiments of the shelf light assembly 10 are shown mounted to a shelf having an overhanging edge, it should be appreciated that the shelf light assembly 10 may instead be used with any suitable shelf assembly. Accordingly, the following descriptions and illustrations herein should be considered illustrative in nature, and thus, not limiting the scope of the present disclosure.

Figure 2:
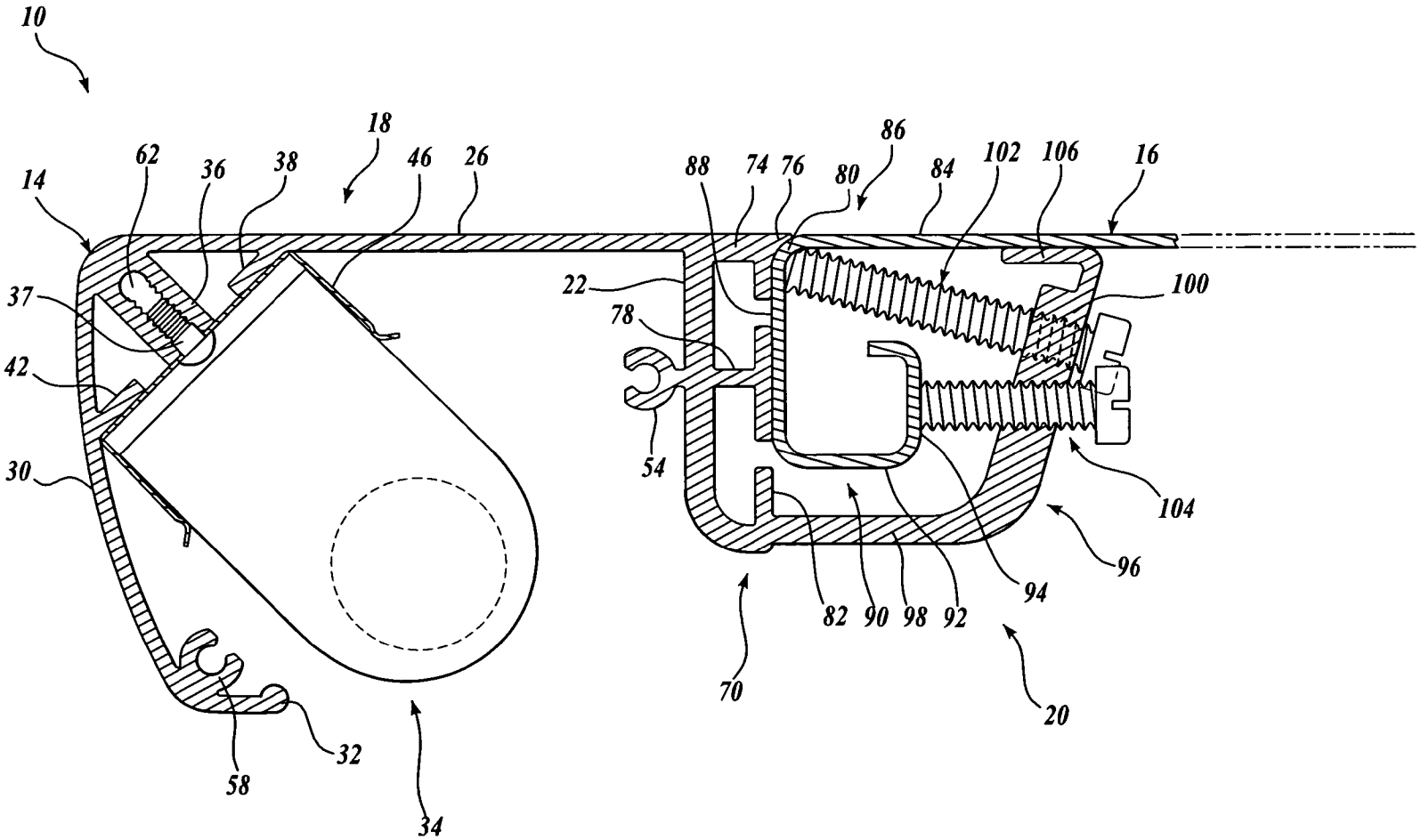
FIG. 2 is a cross-sectional view of the shelf light assembly of FIG. 1.

Referring to FIGS. 1 and 2, the shelf light assembly 10 includes a housing 14 that is preferably extruded aluminum; however, any suitable method and material for forming the housing 14 may also be appreciated. The housing 14 includes a light housing portion 18, a mating portion 70, and a mounting portion 20. The light housing portion 18 is generally C-shaped in cross section and includes a substantially flat, inner face 22, a substantially flat upper face 26, and a curved outer face 30. The inner face 22 and the upper face 26 are substantially elongate to one another and the curved outer face 30 extends downwardly and rearwardly from the upper face 26. The bottom of the curved outer face 30 includes a lip 32 that extends inwardly from the bottom of the curved outer face 30 towards the inner face 22. The bottoms of the inner face 22 and the outer face 30 are spaced from each other, leaving a bottom opening. The housing 14 is extruded in a manner well known in the art and it is cut to a preferred length to fit the target shelf 16. The extruded housing 14 can also be cut to fit the length of multiple shelves positioned adjacent one another in a shelving system.

The housing 14 partially encloses a light source therewithin that directs light through the bottom opening and onto the shelf contents below. Any suitable light source may be used, such as an fluorescent lamp fixture, a light emitting diode (LED) assembly, etc. FIGS. 1 and 2 depict a lamp assembly 34 received within the interior of the housing 14 at the corner defined by the upper face 26 and the curved outer face 30. A preferred method of attachment of the lamp 34 will be hereinafter described.

The housing 14 includes an elongate attachment channel, or an elongate screw boss 36, extruded along the interior of the housing 14 at the corner defined by the intersection of the upper face 26 and the curved outer face 30. The elongate screw boss 36 opens to the interior of the housing 14 at an approximately forty-five degree angle to the upper face 26. First and second shoulders 38 and 42 are extruded along the interior of the housing 14 on opposite sides of the corner defined by the intersection of the upper face 26 and the curved outer face 30. The shoulders 38 and 42 extend into the interior of the housing 14 toward the elongate screw boss 36.

A lamp clip 46 that is substantially U-shaped in cross section is mounted in the interior of the housing 14 such that it spans the corner defined by the intersection of the upper face 26 and the curved outer face 30. The bottom of the lamp clip 46 is mounted against shoulders 38 and 42 and elongate screw boss 36 so that the clip 46 opens to the interior of the housing 14 at an approximately forty-five degree angle to the upper face 26. At least one screw 37 or other threaded fastener is passed through the bottom of the lamp clip 46 and is received into the elongate screw boss 36 to fasten the clip 46 within the housing 14.

The lamp clip 46 is adapted to receive the lamp assembly 34 therein to secure the lamp assembly 34 within the housing 14. The cross-section of the lamp clip 46 generally conforms in shape and size to the cross-sectional shape of the lamp assembly 34 so that the lamp assembly 34 may be tightly received therein. Moreover, the lamp clip 46 is formed from sheet metal or another suitable material, such as plastic, such that the sides of the clip 46 bend out slightly to receive the lamp assembly 34 with a snap fit. The lamp assembly 34 preferably receives power from a power cord (not shown); however, jumpers may be used to connect multiple lamps 34 between adjacent shelves in a shelving system.

The housing 14 includes a plurality of attachment points for securing an end plate 50 to each open end of the of the extruded housing 14 to at least partially enclose the lamp assembly 34 and the other interior components of the light housing portion 18 (only one end plate 50 and one open end of the housing 14 is shown for clarity). The attachment points are defined by first, second, and third longitudinal attachment channels, or extruded longitudinal screw bosses 54, 58, and 62. The first longitudinal screw boss 54 is extruded along the interior of the light housing portion 18 of the housing 14 along the inner face 22. The second longitudinal screw boss 58 is extruded along the interior of the of the light housing portion 18 at the corner defined by the intersection of the curved outer face 30 and the lip 32. The third longitudinal screw boss 62 is extruded along the interior of the light housing portion 18 at the corner defined by the intersection of the upper face 26 and the curved outer face 30. In other words, the third longitudinal screw boss 62 is formed within the bottom of the elongate screw boss 36.

The end plate 50 is formed from sheet metal, plastic, or another suitable material and is secured to the open end of the of the housing 14 by passing a screw or other threaded fastener through the end plate 50 and into each screw boss 54, 58, and 62. The end plate 50 is preferably approximately the same shape and size as the combined cross-sectional shape of the light housing portion 18 and the a mating portion 70 to cover the exposed, open ends of the housing 14 when the shelf light assembly 10 is mounted to a shelf 16. It should be understood that the end plate 50 may be secured to the end of the housing 14 in any other well-known manner, such as by heat welding, glue, etc. Moreover, fewer or more than three screw bosses may be used to secure the end plate 50 to the housing 14, and the screw bosses may instead be formed in other locations within the interior of the light housing portion 18. The end plate 50 includes a cord opening 66 through which the lamp power cord or jumper may pass.

Still referring to FIGS. 1 and 2, the mating portion 70 and mounting portion 20 of the housing 14 will now be described. The mating and mounting portions 70 and 20 of the housing 14 are used to secure the housing 14 to a shelf 16 such that the shelf light assembly 10 can illuminate the contents on a shelf below. The mating and mounting portions 70 and 20 are described as being mateable with a shelf 16 having a substantially flat top face 84 and an overhanging edge 86; however, it should be appreciated that the mating and mounting portions 70 and 20 may be adapted for use with other shelf designs. The overhanging edge 86 includes a front face 88 that extends downwardly from the top face 84 of the shelf 16 and is substantially elongate thereto. The front face 88 turns inwardly to form a folded portion 90 defined by a horizontal face 92 and an upwardly extending inner face 94.

The mating portion 70 includes extruded top, middle, and bottom mating protrusions 74, 78, and 82, respectively, that extend outwardly from the inner surface 22 of the housing 14 and along the length of the housing 14. The top, middle, and bottom mating protrusions 74, 78, and 82 engage the front face 88 of the overhanging edge 86 of a shelf 16. The top mating protrusion 74 extends outwardly from the inner face 22 of the housing 14 and is substantially aligned with the upper face 26 of the housing 14. The top mating protrusion 74 includes a lip 76 that is shaped to engage a curved edge 80 of the shelf 16 defined by the top and front faces 84 and 88 of the shelf 16.

The lip 76 functions to position the housing 14 against the overhanging edge 86 and aids in securing the housing 14 thereto. The lip 76 prevents the light housing portion 18 from falling downwardly and out of engagement with the shelf 16.

Moreover, with the lip 76 engaging the curved edge 80, there is substantially no gap between the lip 76 and the overhanging edge 86, and the top mating protrusion 74 is substantially flush with the top face 84 of the shelf 16. The shelf light assembly 10 therefore acts a continuous, substantially flush extension of the shelf 16.

The middle mating protrusion 78 extends outwardly from the inner face 22 of the housing 14 and engages the front face 88 of the overhanging edge 86 to further aid in positioning the housing 14 against the shelf 16. The bottom mating protrusion 82 serves as an additional mating protrusion. For instance, if the front face 88 was larger than that shown in FIG. 2, both the middle and bottom mating protrusions 78 and 82 would likely engage the front face 88 to position the shelf assembly 10 against the shelf 16.

The mounting portion 20 of the housing 14 includes a clamp 96 that engages the overhanging edge 86 of the shelf 16 to secure the housing 14 to the shelf 16. The clamp 96 is defined by a substantially horizontal portion 98 that extends outwardly from the bottom mating protrusion 82 to pass beneath the folded portion 90 of the overhanging edge 86. The clamp 96 further includes a fastening portion 100 that extends upwardly from the horizontal portion 98 and is positionable behind the folded portion 90 of the overhanging edge 86. The top of the fastening portion 100 folds inwardly toward the front face 88 of the overhanging edge 86 in a substantially horizontal manner to define a return portion 106 that is engageable with the underside of the shelf top face 88.

The fastening portion 100 includes a plurality of threaded holes for receiving threaded fasteners therein to secure the clamp 96 to the overhanging edge 86 of the shelf 16. The fastening portion 100 is preferably angled away from the housing inner face 22 such that a fastener 102 (e.g. a bolt, etc.) may be received within a threaded opening and thereafter engaged with the interior corner of the overhanging edge 86 defined by the upper face 84 and the front face 88. The fastener 102 braces the top and middle mating protrusions 74 and 78 to the front face 88 of the overhanging edge 86 and secures the lip 76 against the curved edge 80 of the shelf 16.

With the lip 76 secured against the curved edge 80, the light housing portion 18 is prevented from falling downwardly and out of engagement with the shelf 16. The fastener 102 also braces the return portion 106 of the clamp 96 against the underside of the shelf top face 84. By engaging the underside of the shelf top face 84, the return portion 106 prevents the counterclockwise rotation of the shelf light assembly 10 about a longitudinal axis defined by the return portion 106. As such, the return portion 106 further prevents the light housing portion 18 from falling downwardly and out of engagement with the shelf 16.

The fastening portion 100 may include additional openings for receiving other fasteners. For instance, a fastener 104 may be received within the fastening portion 100 such that it engages the upwardly extending inner face 94 of the overhanging edge 86. The fastener 104 helps brace the top and middle mating protrusions 74 and 78 to the front face 88 of the overhanging edge 86 and prevents the clamp 96 from falling downwardly and out of engagement with the underside of the shelf top face 84. It should be appreciated that additional fasteners or other means may further be used to secure the shelf light assembly 10 to the shelf 16.

It should be appreciated that a plurality of fasteners 102 and 104 may be received within a plurality of openings formed along the length of the fastening portion 100 to secure the shelf light assembly 10 to the shelf 16. Accordingly, the shelf light assembly 10 is mountable to the shelf 16 at substantially any point along the length of the housing 14, thereby accommodating a variety of shelves having different widths.

Figure 3:
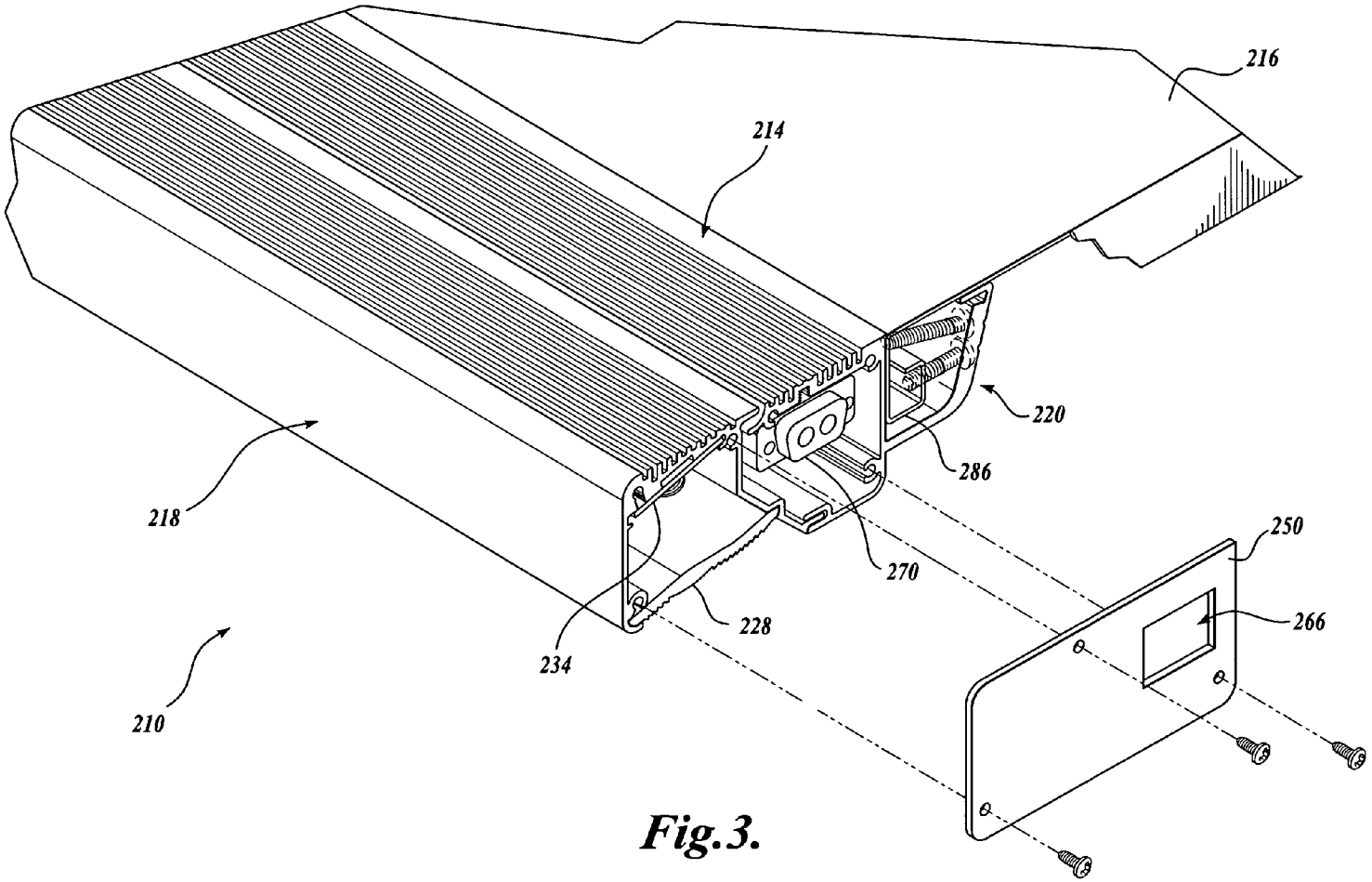
FIG. 3 is an isometric, partially exploded view of a first alternate embodiment of a shelf light assembly mounted to the edge of a shelf.
Figure 4:
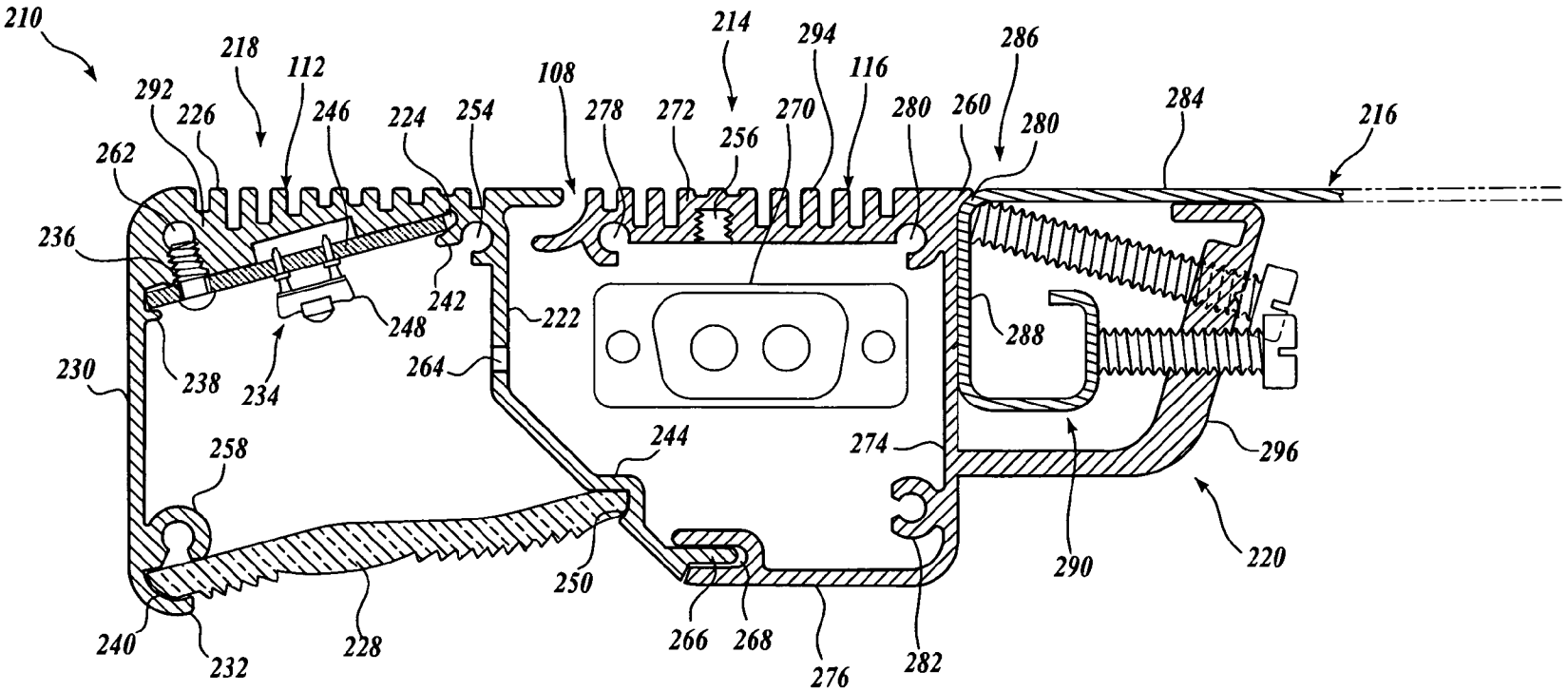
FIG. 4 is a cross-sectional view of the shelf light assembly of FIG. 3.

Referring to FIGS. 3 and 4, a first alternate embodiment of a shelf light assembly 210 is depicted. The shelf light assembly 210 includes an elongated housing defined by a light housing portion 218, a wire housing portion 214, and a mounting portion 220. The wire housing portion 214 is mateable with the light housing portion 218, and the mounting portion 220 extends outwardly from the wire housing portion 214 and is adapted to secure the shelf light assembly 210 to a shelf 216. The light housing portion 218 is preferably extruded aluminum and includes an inner face 222, an outer face 230 disposed opposite the inner face 222, and an upper face or heat sink portion 292 extending therebetween that defines an upper surface 226. The light housing portion 218 may be any suitable shape; however, the inner face 222, outer face 230, and heat sink portion 292 preferably define a substantially C-shaped light housing portion 218 having a bottom opening.

The light housing portion 218 partially encloses a light source therewithin that directs light through the bottom opening and onto the shelf contents below. Preferably, a light emitting diode (LED) assembly 234 is received within an upper interior portion of the light housing portion 218. The LED assembly 234 may be any suitable off-the-shelf light engine that includes a plurality of LEDs 248 mounted in a substantially linear fashion on a printed circuit board (PCB) 246. The PCB 246 is adapted to be electrically connected to a power source through a wiring assembly 270 housed within the wire housing portion 214.

Although the LED assembly 234 may be secured within the light housing portion 218 in any suitable manner, the light housing portion 218 preferably includes an elongate attachment channel, or elongate screw boss 236, extruded along the interior of the light housing portion 218 at the corner defined by the intersection of the heat sink portion 292 and the outer face 230 and opening to the interior of the light housing portion 218. First and second shoulders 238 and 242 are extruded along the interior of the light housing portion 218 on opposite sides of the corner defined by the intersection of the heat sink portion 292 and the outer face 230. The shoulders 238 and 242 extend into the interior of the light housing portion 218 toward the elongate screw boss 236 to define a PCB receiving channel 224. The LED assembly 234 is secured within the light housing portion 218 by sliding the PCB 246 within the PCB receiving channel 224 and thereafter passing at least one fastener through the PCB 246 and into the elongate screw boss 236. In its secured position within the light housing portion 218, the LED assembly 234 directs light down through the opening in the light housing portion 218. Moreover, the heat sink portion 292 helps dissipate heat generated by the LED assembly 234.

A lens 228 is preferably secured within the bottom opening of the light housing portion 218 to direct and distribute the light from the LED assembly 234 onto the shelf contents below. Although the lens 228 may be mounted within the bottom opening in any suitable manner, a lip 232 is preferably formed along the bottom of the outer face 230 to define a first lens receiving portion 240, and a recess 244 is formed in the inner face 222 to define a second lens receiving portion 250. The lens 228 may be slidably received within the first and second lens receiving portions 240 and 250 to position the lens 228 within the bottom opening of the light housing portion 218. The lens 228 and the LED assembly 234 are positioned at substantially the same angle within the light housing portion 218 such that a majority of the light from the LED assembly 234 is directed through the lens 228 and onto the shelf contents.

Still referring to FIGS. 3 and 4, the wire housing portion 214, which is mateable with the light housing portion 218, will now be described in more detail. The wire housing portion 214 is preferably extruded aluminum and includes a heat sink portion 294 that defines an upper surface 272, a bottom face 276 disposed opposite the heat sink portion 294, and an inner face 274 extending therebetween. The wire housing portion 214 may be any suitable cross-sectional shape; however, the heat sink portion 294, bottom face 276, and inner face 274 preferably define a substantially C-shaped wire housing portion 214 having a side opening. The wire housing 214 encloses a wiring assembly 270 (shown schematically) for the LED assembly 234.

The wiring assembly 270 includes all the necessary power cords, wiring, etc. for placing the LED assembly 234 into electrical communication with a power source. The wiring assembly 270 may be mounted within the interior of the wire housing portion 214 by passing a fastener through a portion of the wiring assembly 270 that is received within a elongate screw boss 256 extruded within the heat sink portion 294 of the wire housing portion 214. The wiring assembly 270 includes a power cord that may be either hard wired to the building wiring or plugged into a pre-existing electrical outlet. To connect the wiring assembly 270 to the electrical wiring of a building, and particularly a commercial building, it is normally required that an electrician perform the installation so that it is done according to the National Electrical Code. This can significantly add to the cost of installing the shelf light assembly 210; and thus, it is preferred that the power cord be adapted to plug into a pre-existing electrical outlet. The wiring assembly 270 may also include jumpers that can connect and properly ground multiple LED assemblies 234 between adjacent shelves in a shelving system.

Although the wire housing portion 214 may be mated with the light housing portion 218 in any suitable manner, the bottom face 276 of the wire housing portion 214 preferably defines a mating channel 268 that is adapted to receive a protrusion 266 that extends outwardly from the exterior of the inner face 222 of the light housing portion 218. The protrusion 266 of the light housing portion 218 is received within the mating channel 268 such that the inner face 222 of the light housing portion 218 substantially covers the side opening of the wire housing 218. Moreover, the upper surface 272 of the wire housing portion 214 is substantially flush with the upper surface 226 of the light housing portion 218. At least one opening 264 is formed within the inner face 222 of the light housing portion 218 such that a suitable wire (not shown) may extend between the LED assembly 234 and the wiring assembly 270 to place the LED assembly 234 into electrical communication with the wiring assembly 270.

The heat sink portion 294 of the wire housing portion 214 aids in dissipating heat generated by the wiring assembly 270 when supplying power to the LED assembly 234. Moreover, a gap, or vent 108 is defined between the heat sink portion 292 of the light housing portion 218 and the heat sink portion 294 of the wire housing portion 214 when they are mated together. The vent 108 allows hot air to flow out of the interior of the wire housing portion 214 to aid in cooling the wiring assembly 270.

After mating the light housing portion 218 to the wire housing portion 214, the light housing portion 218 is secured to the wire housing portion 214 by mating an end plate 250 to the open ends of the housing portions 214 and 218 (only one end plate 250 is shown for clarity). The light housing portion 218 and the wire housing portion 214 each include a plurality of attachment points defined by longitudinal attachment channels, or longitudinal screw bosses. The light housing portion 218 includes first, second, and third longitudinal attachment channels, or longitudinal screw bosses 254, 258, and 262. The first longitudinal screw boss 254 is extruded along the interior of the light housing portion 218 at the corner defined by the intersection of the inner face 222 and the upper surface 226. The second longitudinal screw boss 258 is extruded along the interior of the light housing portion 218 at the corner defined by the intersection of the outer face 230 and the lip 232. The third longitudinal screw boss 262 is extruded along the interior of the light housing portion 218 at the corner defined by the intersection of the upper surface 226 and the outer face 230. In other words, the third longitudinal screw boss 262 is formed within the bottom of the elongate screw boss 236.

The wire housing portion 214 similarly includes first, second, and third longitudinal screw bosses 278, 280, and 282. The first longitudinal screw boss 278 is extruded along the interior of the wire housing portion 214 near the forward edge of the upper surface 272. The second longitudinal screw boss 280 is extruded along the interior of the wire housing portion 214 at the corner defined by the intersection of the upper surface 272 and the inner face 274. The third longitudinal screw boss 282 is extruded along the interior of the wire housing portion 214 near the corner defined by the intersection of the inner face 274 and the bottom face 276.

The end plate 250 is formed from sheet metal, plastic, or another suitable material and is secured to the open ends of the light housing portion 218 and the wire housing portion 214 by passing a screw or other threaded fastener through the end plate 250 and into each longitudinal screw boss 254, 258, 262, 278, 280, and 282. The end plate 250 is preferably approximately the same shape and size as the combined cross-sectional shape of the light housing portion 218 and the wire housing portion 214 to cover the open end of the shelf light assembly 210. It should be understood that the end plate 250 may be secured to the open end of the shelf light assembly 210 in any other well-known manner, such as by heat welding, glue, etc. Moreover, fewer or more than six screw bosses may be used to secure the end plate 250 to the open end of the shelf light assembly 210, and the screw bosses may instead be formed in other locations within the interior of the housing portions 214 and 218. The end plates 250 include a cord opening 266 through which a portion of the wiring assembly 270 may pass to place the wiring assembly 270 and LED assembly 234 into electrical communication with a power source or a wiring assembly 270 of an adjacent shelf light assembly 210.

The light housing portion 218 and the wire housing portion 214 are mated to an edge of a shelf 216, and they are secured to the shelf 216 with the mounting portion 220. The wire housing portion 214 and the mounting portion 220 are described as being mateable and securable to a shelf 216 having a substantially flat top face 284 and an overhanging edge 286; however, it should be appreciated that the wire housing portion 214 and mounting portion 220 may be adapted for use with other shelf designs. The overhanging edge 286 includes a front face 288 that extends downwardly from the top face 284 of the shelf 216 and is substantially elongate thereto. The front face 288 turns inwardly to form a folded portion 290. The wire housing portion 214 is adapted to mate with the overhanging edge 286 such that the wire housing portion 214 and the light housing portion 218 form a substantially flush and continuous extension of the shelf 216.

The mounting portion 220 is defined by the inner face 274, which is substantially flat such that it abuts the front face 288 of the overhanging edge 286 without defining a substantial gap therebetween. The mounting portion 220 further includes a lip 260 formed on the upper exterior portion of the inner face 274 that is shaped to engage a curved edge 280 of the shelf 216 defined by the top face 284 and the front face 288 of the shelf 216. The lip 260 functions to position the wire housing portion 214 against the overhanging edge 286 and aids in securing the wire housing portion 214 thereto. The lip 260 prevents the light housing portion 218 from falling downwardly and out of engagement with the shelf 216. Moreover, with the lip 260 engaging the curved edge 280, there is substantially no gap between the lip 260 and the overhanging edge 286, and the upper surface 272 of the wire housing portion 214 is substantially flush with the top face 284 of the shelf 216. The shelf light assembly 210 therefore acts a continuous, substantially flush extension of the shelf 216.

The mounting portion 220 further includes a clamp 296 that engages the overhanging edge 286 of the shelf 216 to secure the wire housing portion 214 to the shelf 216. The clamp 296 is substantially identical to the clamp 96 described above; and therefore, a further description of the clamp 296 and the manner in which it secures the wire housing portion 214 to the shelf 216 will not be hereinafter provided.

Figure 5:
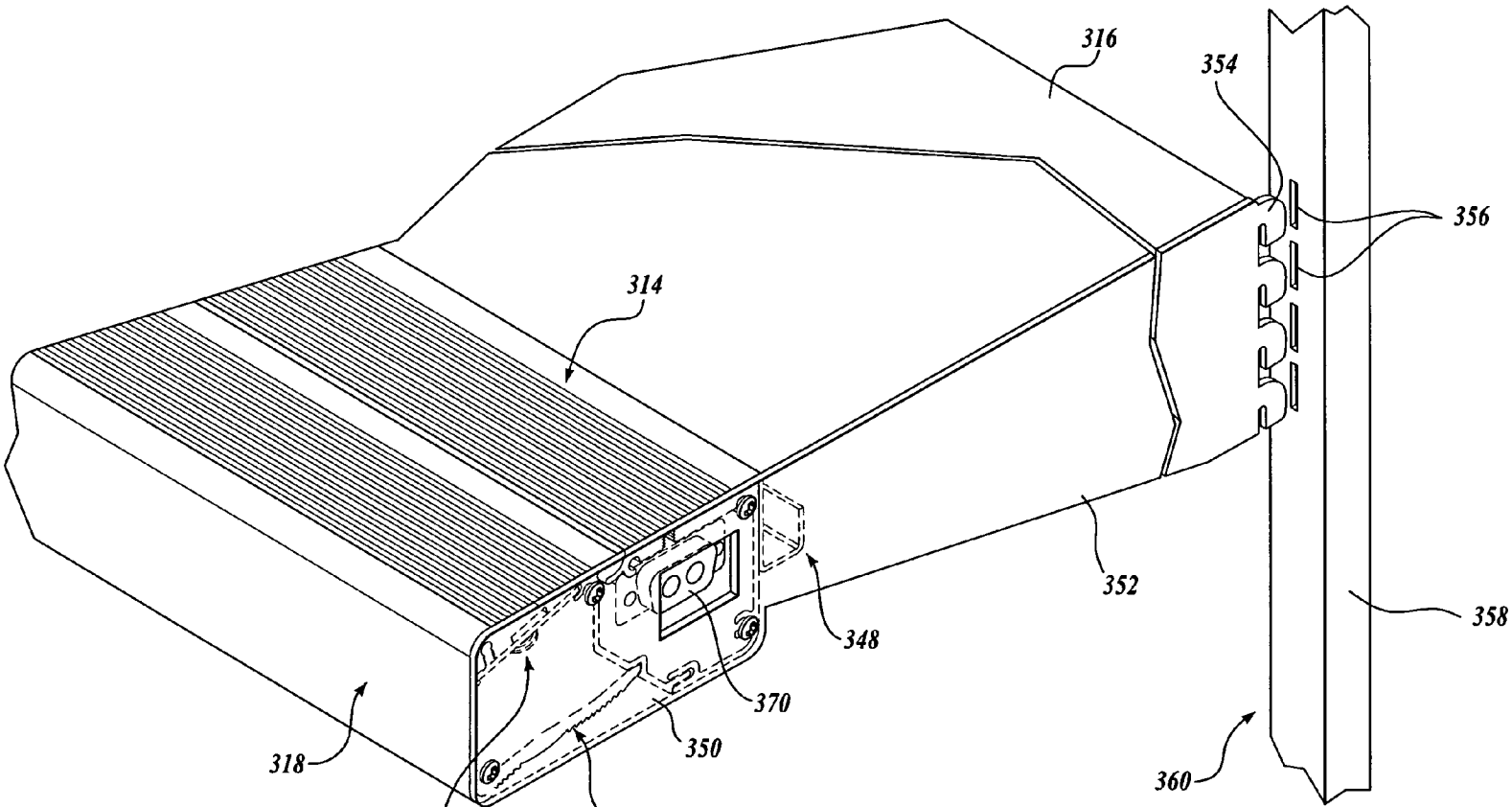
FIG. 5 is an isometric view of a second alternate embodiment of a shelf light assembly mounted to the edge of a shelf.
Figure 6:
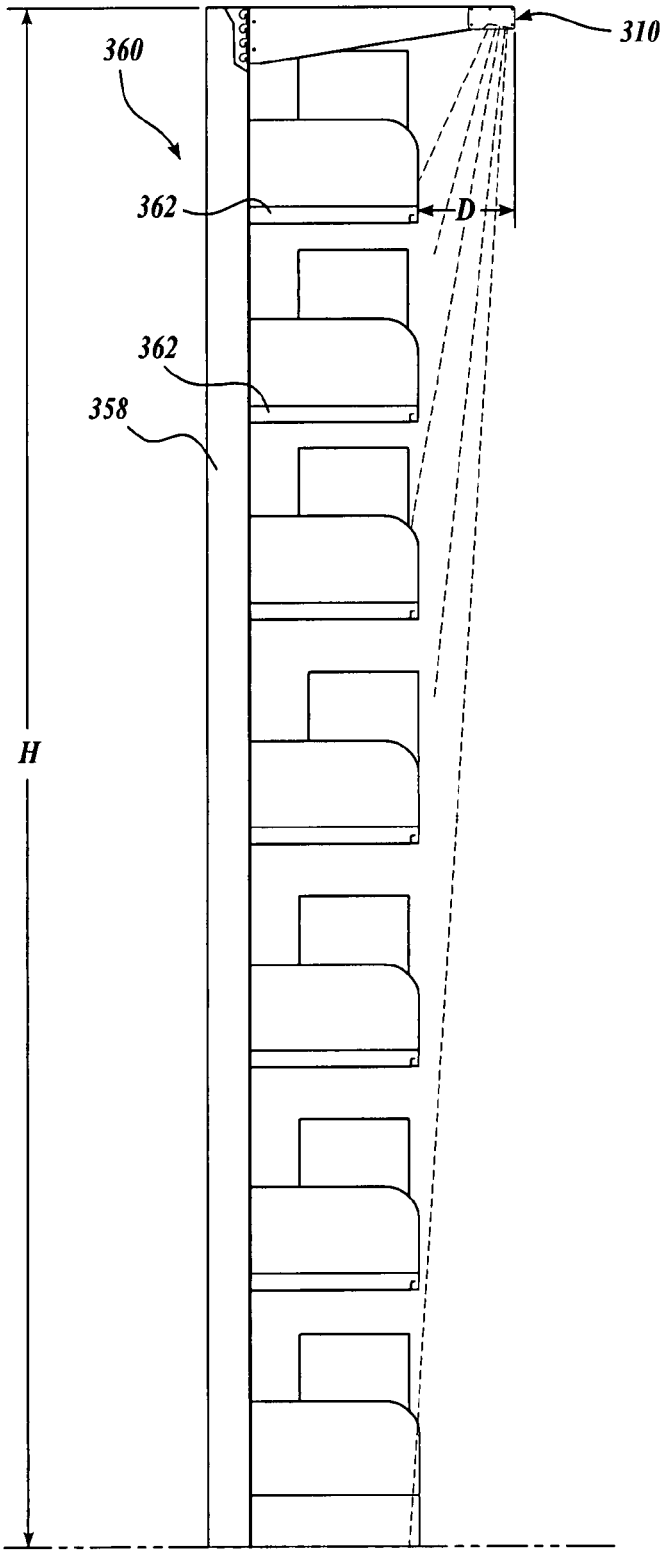
FIG. 6 is a side view of the shelf light assembly of FIG. 5 mounted to a shelving unit.

Referring to FIGS. 5 and 6, a second alternative embodiment of a shelf light assembly 310 is depicted. The shelf light assembly 310 includes a light housing portion 318 having an LED assembly 334 and a lens 328, and a wire housing portion 314 substantially enclosing a wiring assembly 370. The shelf light assembly 310 is substantially identical to the shelf light assembly 210 described above except that the shelf light assembly 310 does not include a mounting portion 220. The shelf light assembly 310 is instead mounted to a shelving unit 360 through extension brackets 348 having an end plate portion 350 and an extension portion 352 (only one extension bracket 348 is shown for clarity). The end plate portion 350 is mounted to the open end of the light housing portion 318 and the wire housing portion 314 in a similar manner to that described above with reference to the end plate 250. The extension portion 352 extends rearwardly from the end plate portion 350 and includes a plurality of hooks 354 formed on its end that are receivable within apertures 356 in a shelf column 358 of the shelving unit 360.

The shelf light assembly 310 may include a shelf portion 316 that extends transversely between the extension brackets 348 to define a shelf for the shelving unit. In the alternative, the shelf light assembly 310 may be mounted to the shelving column 358 above a plurality of stacked shelves 362 of the shelving unit 360, as shown in FIG. 6. The shelf light assembly may be positioned at a predetermined height from the bottom of the shelving unit 360 and a predetermined distance from the back of the shelving unit 360 such that a majority of the light is directed onto the lower shelves and the shelves are evenly illuminated. Preferably, the nominal horizontal distance D between the end of the shelving unit 310 and the end of the shelves 362 is about ten percent of the overall height H of the shelving unit 360. With the shelf light assembly 310 positioned on the shelving unit 360 as such, the light from the LED assembly 334 will be, to a large extent, evenly distributed over the shelves 362.

The lens 328 of the shelf light assembly 310 may further aid in distributing the light from the LED assembly 334 onto the shelf contents below. The lens 328 is preferably a linear fresnel type lens that is designed to project a majority of the light being emitted from the LED assembly 334 onto the lower shelves 362 when the shelf light assembly 310 is positioned on the shelving unit 360 in the manner described above. The facets of the linear fresnel lens 328 are any suitable geometry (as shown on the lens 228 in FIG. 4) that are capable of distributing the light as such.

While illustrative embodiments have been illustrated and described, it will be appreciated that various changes can be made therein without departing from the spirit and scope of the present disclosure.

The invention claimed is:

1. A light assembly for connection to a shelf having a top face, a front face, and a front edge defined by the intersection of the top face and the front face, the light assembly comprising:

(a) an elongated housing having an inner face, an outer face formed opposite the inner face, and an upper face extending between the inner face and the outer face, the elongated housing adapted to receive a light source therein;

(b) a mating portion extending from the inner face of the elongated housing, the mating portion abuttable with the front face of the shelf such that the upper face of the elongated housing is substantially flush with the top face of the shelf to form a continuous extension of the top face of the shelf; and (c) a clamp extending from the mating portion, the clamp including a horizontal portion extending from the mating portion and a fastening portion extending upwardly from the horizontal portion, wherein the fastening portion receives at least one fastener that engages an interior corner of the shelf defined by the top face and the front face of the shelf to brace the elongated housing and the mating portion against the front face of the shelf.

2. The light assembly of claim 1, wherein the mating portion is defined by a plurality of mating protrusions that extend outwardly from the inner face of the elongated housing and abut the front face of the shelf.

3. The light assembly of claim 2, wherein the mating portion further comprises a lip formed on an upper edge of the inner face, wherein the lip is engageable with the front edge of the shelf to position the upper face of the elongated housing substantially flush with the top face of the shelf to form a continuous extension of the shelf.

4. The light assembly of claim 1, wherein the fastening portion is adapted to engage an underside of the top face of the shelf.

5. The light assembly of claim 1, wherein the fastening portion includes a plurality of threaded openings adapted to receive a plurality of fasteners along the length of the slot.

6. The light assembly of claim 1, wherein a bottom opening is defined by the outer face and the inner face of the elongated housing.

7. The light assembly of claim 6, wherein the light source is secured within an interior corner of the elongated housing defined by the upper face and the outer face such that light source directs light towards the bottom opening.

8. The light assembly of claim 7, wherein the outer face, the upper face, and the inner face of the elongated housing define first and second open ends of the elongated housing.

9. The light assembly of claim 8, further comprising first and second end plates coupled to the first and second open ends of the elongated housing.

10. The light assembly of claim 8, wherein the clamp comprises first and second extension brackets coupled in part to the first and second open ends of the elongated housing, the first and second extension brackets adapted to engage a shelving unit such that the elongated housing is positioned above and outwardly from the shelving unit so that it may project light on the shelving unit below.

11. The light assembly of claim 1, wherein the elongated housing is defined by a light housing portion adapted to receive a light source therein, and a wire housing portion adapted to receive a wiring assembly therein, wherein the light housing portion is mateable with the wire housing portion.

12. The light assembly of claim 11, wherein the light housing portion comprises a light housing inner face, a light housing outer face formed opposite the light housing inner face, and a light housing upper face extending between the light housing inner face and the light housing outer face.

13. The light assembly of claim 12, wherein a bottom opening is defined by the light housing outer face and the light housing inner face.

14. The light assembly of claim 12, wherein a light fastening member is disposed within an interior corner of the light housing portion defined by the light housing upper face and the light housing outer face, such that when the light fastening member receives a light source, the light source directs light towards the bottom opening.

15. The light assembly of claim 14, wherein a lens is positioned within the bottom opening of the light housing portion and directs light from the light source onto the contents of a shelf therebelow.

16. The light assembly of claim 12, wherein the wire housing portion comprises a wire housing upper face, a wire housing bottom face formed opposite the wire housing upper face, and a wire housing inner face extending between the wire housing upper face and the wire housing bottom face.

17. The light assembly of claim 16, wherein the mating portion is defined by a lip extending from the inner face of the wire housing portion, the lip engageable with the front edge of the shelf to position the upper face of the wire housing portion substantially flush with the top face of the shelf to form a continuous extension of the shelf.

18. The light assembly of claim 17, wherein the light housing portion is mateable with the wire housing portion such that the upper face of the light housing portion is substantially flush with the upper face of the wire housing portion.

19. A light assembly for connection to a shelf having a top face and an overhanging edge, the light assembly comprising:

(a) an elongated housing having an inner face, an outer face formed opposite the inner face, and an upper face extending between the inner face and the outer face, the elongated housing adapted to receive a light source therein;

(b) a mating portion extending from the inner face of the elongated housing, the mating portion abuttable with the shelf such that the upper face of the elongated housing is substantially flush with the top face of the shelf to form a continuous extension of the shelf and such that no portion of the elongated housing extends over the top surface of the shelf; and (c) a clamp extending from the mating portion, the clamp including a horizontal portion extending from the mating portion and a fastening portion extending upwardly from the horizontal portion, the fastening portion receives at least one fastener that engages an interior corner of the shelf defined by the top face and the overhanging edge of the shelf to brace the elongated housing and the mating portion against the overhanging edge of the shelf.

20. A light assembly for connection to a shelf having a top face, a front face, and a front edge defined by the intersection of the top face and the front face, the light assembly comprising:

(a) an elongated housing, comprising:

(i) a light housing portion adapted to receive a light source therewithin, the light housing portion having a light housing inner face, a light housing outer face formed opposite the light housing inner face, and a light housing upper face extending between the light housing inner face and the light housing outer face, the light housing upper face defining a light housing heat sink portion; and (ii) a wire housing portion adapted to receive a wiring assembly therein, the wire housing portion having a wire housing upper face that defines a wire housing heat sink portion, a wire housing bottom face formed opposite the wire housing upper face, and a wire housing inner face extending between the wire housing upper face and the wire housing bottom face, the wire housing portion mateable with the light housing portion such that an upper face of the light housing portion is substantially flush with an upper face of the wire housing portion;

(b) a mating portion extending from the inner face of the wire housing portion, the mating portion abuttable with the shelf such that the upper face of the wire housing portion is substantially flush with the top face of the shelf to form a continuous extension of the shelf, wherein the mating portion is defined by a lip extending from the inner face of the wire housing portion, the lip engageable with the front edge of the shelf to position the upper face of the wire housing portion substantially flush with the top face of the shelf to form a continuous extension of the shelf; and (c) means for securing the elongated housing to the shelf.

21. The light assembly of claim 20, wherein the means for securing the elongated housing to the shelf comprises a clamp extending from the mating portion, the clamp adapted to receive at least one fastener to secure the elongated housing to the shelf.

22. The light assembly of claim 20, wherein the means for securing the elongated housing to the shelf comprises first and second extension brackets receivable on first and second open ends of the elongated housing, the first and second extension brackets securable to a portion of the shelf.

* * * * *